US006224424B1

(12) United States Patent
Chen

(10) Patent No.: US 6,224,424 B1
(45) Date of Patent: May 1, 2001

(54) MULTI-LINE SIGNAL CABLE

(76) Inventor: Gary Chen, 4F, No. 70, La. 81, Yung-Yeh Rd., Hsin-tien City, Taipei Hsien (TW)

( * ) Notice: Subject to any disclaimer, the term of this patent is extended or adjusted under 35 U.S.C. 154(b) by 0 days.

(21) Appl. No.: 09/271,193

(22) Filed: Mar. 17, 1999

(51) Int. Cl.[7] ..... H01R 9/03

(52) U.S. Cl. ..... 439/610

(58) Field of Search ..... 439/579, 497, 439/98, 610, 680

(56) References Cited

U.S. PATENT DOCUMENTS 2,876,274 * 3/1959 Cole et al. ..... 174/77

4,974,075 * 11/1990 Nakajima ..... 439/579

* cited by examiner

*Primary Examiner*—Brian Sircus
*Assistant Examiner*—Javaid Nasri
(74) *Attorney, Agent, or Firm*—Sheridan Ross P.C.

(57) ABSTRACT

A multi-line signal cable includes a plurality of signal lines, an inner conductive jacket and an outer insulating jacket. Each signal line includes a conductive core, a dielectric layer around the conductive core, and a metal shielding layer around the dielectric layer. The inner conductive jacket is sheathed on the signal lines such that the metal shielding layer of each of the signal lines is in direct electrical contact with the inner conductive jacket. The metal shielding layer of each of the signal lines and the inner conductive jacket are adapted to establish electrical connection with a metal casing of an electrical connector for grounding purposes when the multi-line signal cable is terminated by the electrical connector. The outer insulating jacket is sheathed on the inner conductive jacket.

10 Claims, 2 Drawing Sheets

MULTI-LINE SIGNAL CABLE

BACKGROUND OF THE INVENTION

1. Field of the Invention

The invention relates to a signal cable, more particularly to a multi-line signal cable for connecting a personal computer, such as a desktop or notebook computer, to a peripheral device, such as a computer monitor, printer, or scanner.

2. Description of the Related Art

FIG. 1 illustrates a conventional multi-line signal cable 1 that is used to connect a personal computer (not shown) and a computer monitor (not shown). The signal cable 1 includes a plurality of coaxial signal lines 13 and a plurality of insulated single-core ground lines 14 bundled inside an inner conductive jacket 12, and an outer insulating jacket 11 sheathed on the inner conductive jacket 1.2. One end of the signal cable 1 is connected to the computer monitor. The other end of the signal cable 1 is terminated by an electrical connector 2 for electrical connection with the personal computer.

Referring to FIG. 2, each of the coaxial signal lines 13, such as R, G, B video signal lines, includes a conductive core 131, a dielectric layer 1.32 around the conductive core 131, a metal shielding layer 133 around the dielectric layer 132, and an insulation layer 134 around the metal shielding layer 133.

It is noted that, aside from reducing the diameters of the coaxial signal lines 13 and the ground lines 14, no other scheme is available for reducing the size of the signal cable 1. However, a reduction in the diameters of the coaxial signal lines 13 and the ground lines 14 will have an adverse effect on the quality of signal transmission.

SUMMARY OF THE INVENTION

Therefore, the object of the present invention is to provide a relatively small and relatively low-cost multi-line signal cable of the aforementioned type that is capable of maintaining good signal transmission quality.

According to the present invention, a multi-line signal cable is adapted to be terminated at one end by an electrical connector having a metal casing, and comprises:

- a plurality of signal lines, each including a conductive core, a dielectric layer around the conductive core, and a metal shielding layer around the dielectric layer;
- an inner conductive jacket sheathed on the signal lines such that the metal shielding layer of each of the signal lines is in direct electrical contact with the inner conductive jacket, the metal shielding layer of each of the signal lines and the inner conductive jacket being adapted to establish electrical connection with the metal casing of the electrical connector for grounding purposes when the multi-line signal cable is terminated by the electrical connector; and
- an outer insulating jacket sheathed on the inner conductive jacket.

Preferably, the metal shielding layer of each signal line is formed as a metal wire wound around the dielectric layer.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
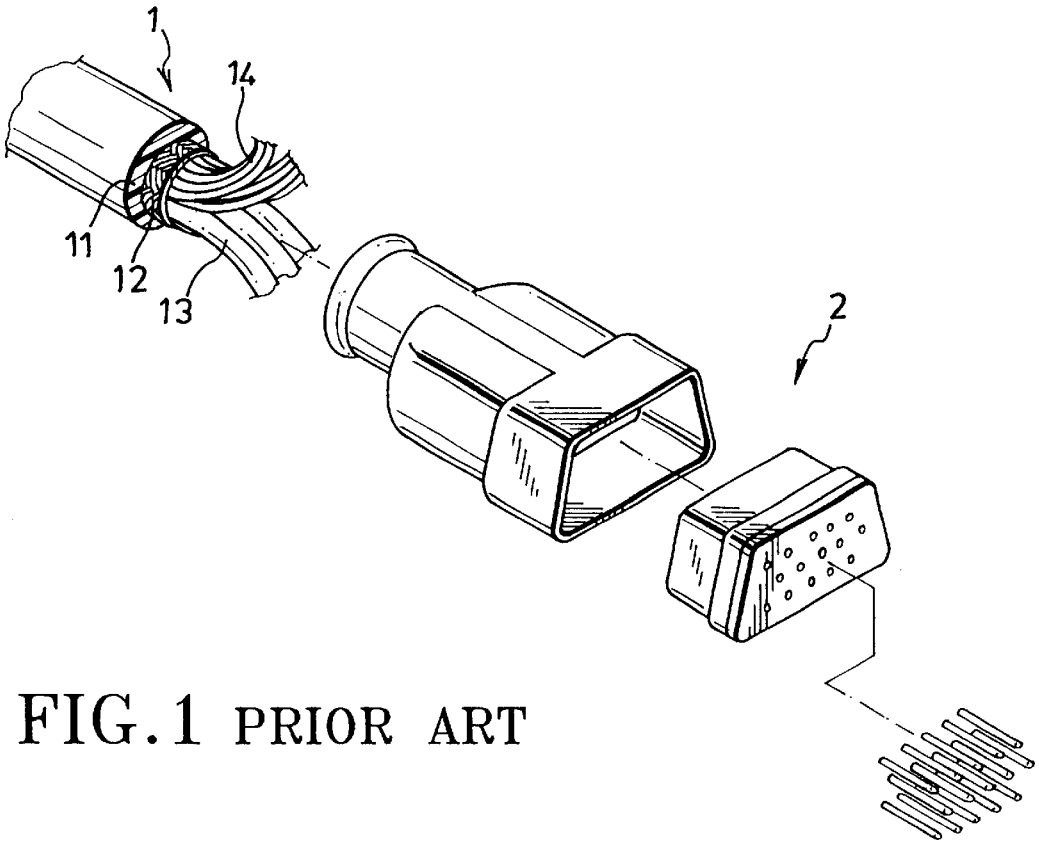
FIG. 1 PRIOR ART
FIG. 1 is an exploded perspective view illustrating a conventional multi-line signal cable and an electrical connector for terminating one end of the signal cable.
Figure 2:
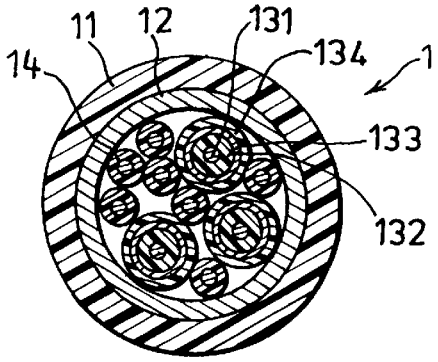
FIG. 2 PRIOR ART
FIG. 2 is a cross-sectional view of the conventional multi-line signal cable.
Figure 3:
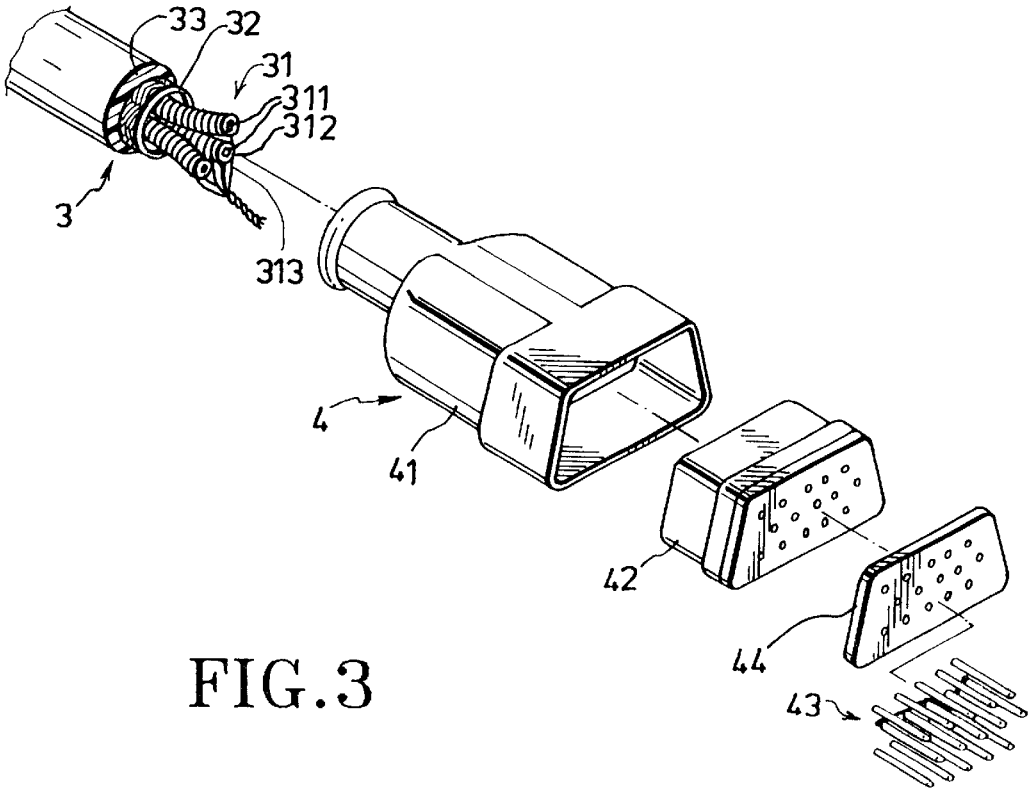
FIG. 3 is an exploded perspective view illustrating the preferred embodiment of a multi-line signal cable according to the present invention, and an electrical connector for terminating one end of the signal cable.

FIG. 3 illustrates the preferred embodiment of a multi-line signal cable 3 according to the present invention. The signal cable 3 is used to connect a personal computer (not shown) and a computer monitor (not shown), and includes a plurality of signal lines 31 bundled inside an inner conductive jacket 32, and an outer insulating jacket 33 sheathed on the inner conductive jacket 32. One end of the signal cable 3 is connected to the computer monitor. The other end of the signal cable 3 is terminated by an electrical connector 4 for electrical connection with the personal computer.

The electrical connector 4 includes a metal casing 41, an insulating terminal-mounting seat 42, a plurality of connector terminals 43, and a metal shielding plate 44. The connector terminals 43 include signal terminals and ground terminals, and are secured to the terminal-mounting seat 42 in a known manner. The ground terminals are connected electrically to each other. The terminal-mounting seat 42 is mounted inside the metal casing 41. The shielding plate 44 can be disposed in front of the terminal-mounting seat 42, as shown in FIG. 3, and is formed with a plurality of holes for access to the connector terminals 43. Alternatively, the shielding plate 44 can be disposed behind the terminal-mounting seat 42 inside the metal casing 41. The shielding plate 44 enhances the electromagnetic shielding effect of the electrical connector 4.

Figure 4:
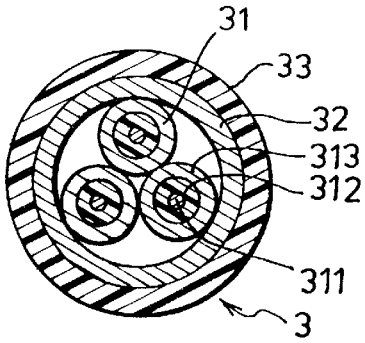
FIG. 4 is a cross-sectional view of the signal cable of the preferred embodiment.

In this embodiment, there are three signal lines 31 for R, G, B video signals. Referring to FIG. 4, each of the signal lines 31 includes a conductive core 311, a dielectric layer 312 around the conductive core 131, and a metal shielding layer 313 around the dielectric layer 312. The metal shielding layer 313 is in direct electrical contact with the inner conductive jacket 32. In this embodiment, the metal shielding layer 313 is formed as a metal wire wound around the dielectric layer 312.

In use, when the signal cable 3 is terminated by the electrical connector 4, the metal shielding Layers 313 of the signal lines 31 and the inner conductive jacket 32 of the signal cable 3 can be connected electrically to the ground terminals via the metal casing 41 of the electrical connector 4.

The advantages of the multi-line signal cable 3 of the present invention are as follows:

1. Because the metal shielding layers 313 of the signal lines 31 can be connected electrically to the ground terminals via the metal casing 41 of the electrical connector 4, the need for dedicated ground lines as taught in the prior art can be obviated, thereby reducing the size and cost of the signal cable 3.

2. Since each signal line 31 only includes a conductive core 311, a dielectric layer 312 and a metal shielding layer 313, the size of the signal line 31 can be reduced. Also, the cost of the signal cable 3 can be further reduced due to the absence of a dedicated insulation layer around the metal shielding layer 313.

3. Because there is no need to reduce the size of the conductive core 311 of each signal line 31 to reduce the size of the signal cable 3, good signal transmission quality can be maintained.

4. Because the metal shielding layer 313 of each signal line 31 is in direct electrical contact with the inner conductive jacket 32, the grounding area established with the electrical connector 4 is increased.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-line signal cable adapted to be terminated at one end by an electrical connector having a metal casing, said multi-line signal cable comprising:

a plurality of signal lines, each including a conductive core, a dielectric layer around said conductive core, and a metal shielding layer around said dielectric layer;

an inner conductive jacket sheathed on said signal lines such that said metal shielding layer of each of said signal lines is in direct electrical contact with said inner conductive jacket, said metal shielding layer of each of said signal lines and said inner conductive jacket being adapted to establish electrical connection with the metal casing of the electrical connector for grounding purposes when said multi-line signal cable is terminated by the electrical connector; and an outer insulating jacket sheathed on said inner conductive jacket.

2. The multi-line signal cable as claimed in claim 1, wherein said metal shielding layer is formed as a metal wire wound around said dielectric layer.

3. The multi-line signal cable as set forth in claim 1, wherein said signal cable has first and second ends and said first end is connected to a computer monitor and said second end is connected to a personal computer.

4. The multi-line signal cable as set forth in claim 1 wherein said electrical connector comprises an insulating terminal-mounting seat, a plurality of connector terminals and a metal shielding plate.

5. The multi-line signal cable as set forth in claim 4, wherein said connector terminals include signal terminals and ground terminals secured to said terminal-mounting seat.

6. The multi-line signal cable as set forth in claim 5, wherein said ground terminals are connected electrically to each other.

7. The multi-line signal cable as set forth in claim 5, wherein said inner conductive jacket of said signal cable is connected electrically to said ground terminals via said metal casing.

8. The multi-line signal cable as set forth in claim 4, wherein said terminal mounting seat is mounted inside said metal casing.

9. The multi-line signal cable as set forth in claim 4, wherein said shielding plate is disposed behind said terminal mounting seat inside said metal casing, said shielding plate enhancing the electromagnetic shielding effect of said electrical connector.

10. A multi-line signal cable adapted to be terminated at one end by an electrical connector having a metal casing, said multi-line signal cable comprising:

a plurality of signal lines, each including a conductive core, a dielectric layer around said conductive core, and a metal shielding layer formed as a metal wire wound around said dielectric layer;

an inner conductive jacket sheathed on said signal lines such that said metal shielding layer of each of said signal lines is in direct electrical contact with said inner conductive jacket, said metal shielding layer of each of said signal lines and said inner conductive jacket being adapted to establish a direct electrical connection with the metal casing of the electrical connector for grounding purposes when said multi-line signal cable is terminated by the electrical connector; and an outer insulating jacket sheathed on said inner conductive jacket.

* * * * *